United States Patent [19]

Uchiyama

[11] Patent Number: 5,000,089

[45] Date of Patent: Mar. 19, 1991

[54] PICTURE FORMING METHOD, PICTURE THEREOF AND PICTURE FORMING MATERIAL

[75] Inventor: Koichi Uchiyama, Ibaragi, Japan

[73] Assignee: Riso Kagaku Corporation, Tokyo, Japan

[21] Appl. No.: 462,537

[22] Filed: Jan. 3, 1990

[30] Foreign Application Priority Data

| | | | |
|---|---|---|---|
| Jan. 17, 1989 | [JP] | Japan | 1-5914 |
| Jan. 17, 1989 | [JP] | Japan | 1-5915 |
| Oct. 27, 1989 | [JP] | Japan | 1-278589 |
| Dec. 6, 1989 | [JP] | Japan | 1-315421 |

[51] Int. Cl.[5] ..... B41M 1/12

[52] U.S. Cl. ..... 101/129; 101/127.1

[58] Field of Search ..... 101/129, 127, 128.21; 101/128.4, 401.1; 427/272, 282, 265

[56] References Cited

U.S. PATENT DOCUMENTS 2,659,171 11/1953 Hill ..... 427/282

*Primary Examiner*—Edgar S. Burr
*Assistant Examiner*—C. Bennett
*Attorney, Agent, or Firm*—Kanesaka and Takeuchi

[57] ABSTRACT

A picture forming method in which a picture forming material having fluidity at least under a predetermined condition is forced to pass through a memographic plate having an original image in pores, to form a sterographic picture corresponding to said original image of said memeographic plate.

12 Claims, 11 Drawing Sheets

PICTURE FORMING METHOD, PICTURE THEREOF AND PICTURE FORMING MATERIAL

BACKGROUND OF THE INVENTION

1. Field of the Invention:

This invention relates to a picture forming method using a mimeographic master plate, a picture formed by the method, a picture forming material, and a picture forming apparatus.

2. Description of the Related Art:

Heretofore, for forming a cubic picture with an embossed letter, design, etc., a template or mold having a cavity corresponding to such a cubic picture is provided, then melted metal or resin is poured into the cavity of the template, and the metal or resin is taken out from the template after cooled to become solidified. In an alternative method, a cubic picture is formed in relief by directly carving a material. These conventional methods are time- and cost-consuming. Consequently any much simpler method for an embossed picture has been cherished.

SUMMARY OF THE INVENTION

It is therefore an object of this invention to provide an effective method of forming a cubic picture simply and precisely in a relatively short time.

Another object of the invention is to provide a picture forming material suitable for use in forming a cubic picture.

Still another object of the invention is to provide a picture forming apparatus suitable for use in forming a cubic picture.

A further object of the invention is to provide a cubic picture formed by the above-mentioned method.

According to this invention, there is provided a picture forming method in which a picture forming material having fluidity at least under a predetermined condition is forced to pass through a mimeographic master plate having an original image in pores, to form a stereographic picture corresponding to said original image of said mimeographic master plate.

The above and other advantages, features and additional objects of this invention will be manifest to those skilled in the art upon making reference to the following detailed description and the accompanying drawings in which several embodiments incorporating the principles of this invention are shown by way of illustrative examples.

BRIEF DESCRIPTION OF THE DRAWINGS

FIG. 5(*b*) is an enlarged cross-sectional view showing the surface of the picture of FIG. 5(*a*);

FIG. 5(*c*) is an enlarged perspective view showing the surface of the picture of FIG. 5(*b*);

FIG. 6(*b*) is an enlarged cross-sectional view of a picture having been formed in the method according to another aspect of the invention;

DETAILED DESCRIPTION

Figure 5A:
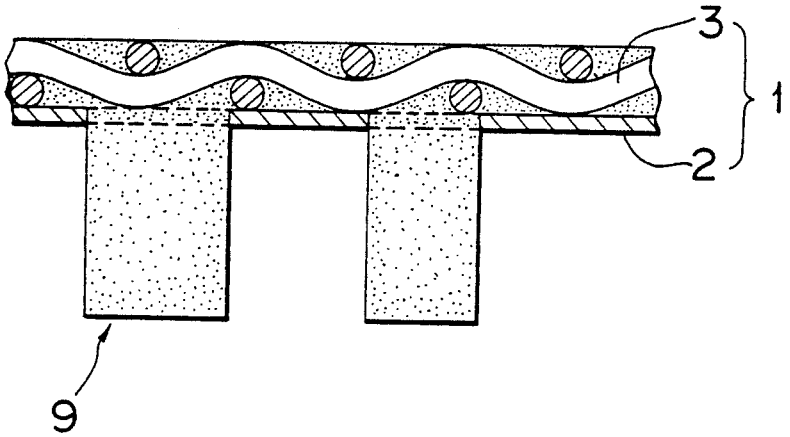
FIG. 5(*a*) is an enlarged cross-sectional view showing the picture having been formed in the method according to claim 1.
Figure 5B:
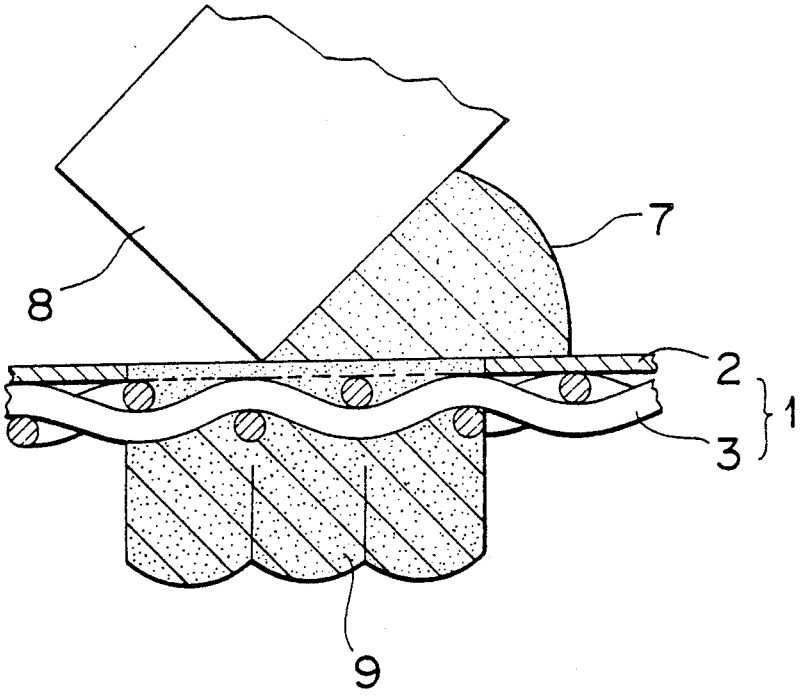
Figure 5C:
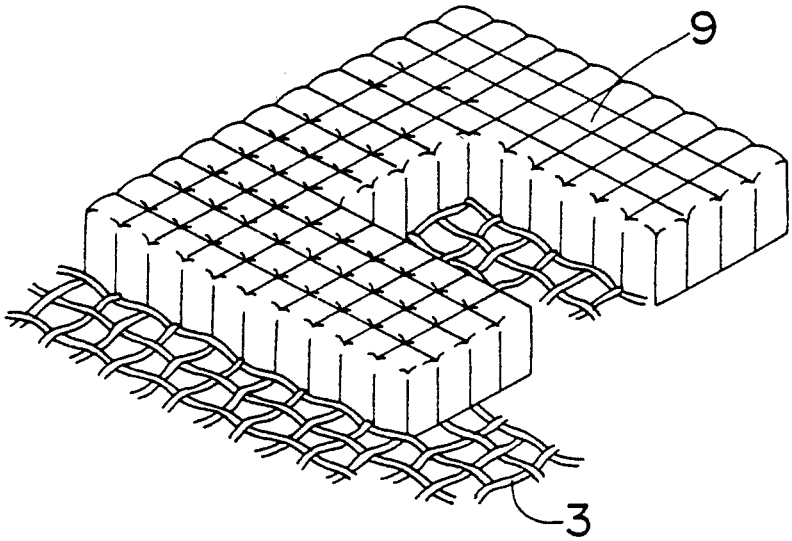

As shown in FIG. 5(*a*), a mimeographic master plate is a screen master (hereinafter called "master") 1 composed of a thermosensitive film 2 of thermoplastic synthetic resin and a porous screen 3 in the form of a mesh, both adhered together. For making an original picture in the master 1, a thermal head may be used to directly make pores in the master 1. Alternatively, the master 1 and an original may be superimposed in such a manner that the thermosensitive film 2 of the master 1 and the picture side of the original contact each other, whereupon light may be applied over the master 1 from its screen side to form in the thermosensitive film 2 an original picture in pores corresponding to the picture of the original. In the illustrated embodiments, an original picture was made in the master 1 by using a plate making apparatus called "PRINT GOKKO" (tradename, product of RISO KAGAKU KOGYO KABUSHIKI KAISHA).

Then, the master 1 with the original picture is put up on a picture forming apparatus 4 which is equipped with a master set-up mechanism. This apparatus 4 comprises a rectangular base frame 5 smaller than the master 1, and a rectangular attachment frame 6 to be fitted circumferentially on the base frame 5. For setting-up, the master 1 with the thermosensitive film 2 facing downwardly is placed on the top surface of the base frame 5, and the attachment frame 6 is fitted around the outer peripheral surface of the base frame 5 with the master 1 clamped between the two frames 5, 6 to pull the peripheral edge downwardly, thereby giving a uniform and a suitable amount of tension to the picture surface of the master 1. Thus the master 1 has been set up in such a manner that its picture surface lies horizontally. As mentioned below, the larger the tension of the master 1 is, the more the precision of a picture formed will be improved. From an operational view point, it is preferred to set up the master 1 in a horizontal posture.

Figure 1:
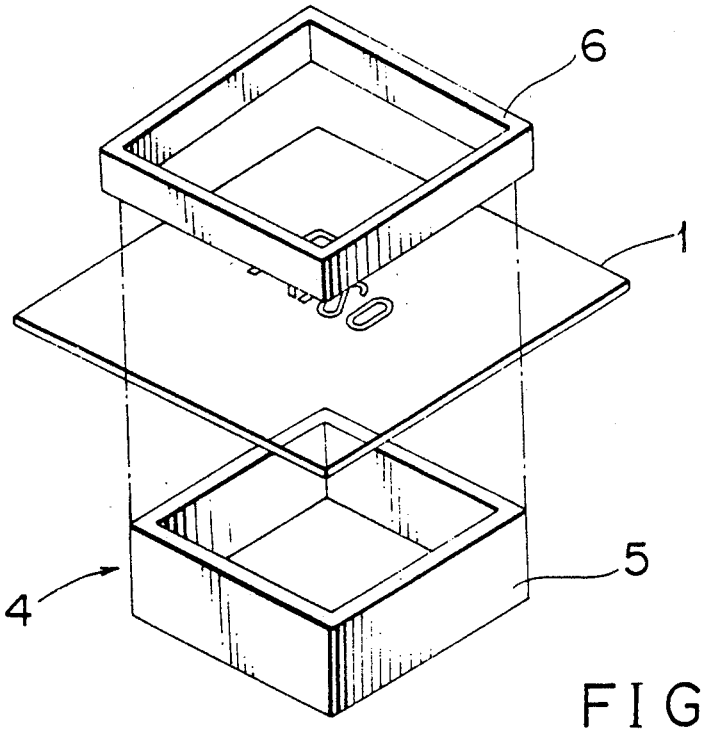
FIG. 1 is an exploded perspective view showing a picture forming apparatus and a mimeographic master plate according to the present invention.
Figure 2:
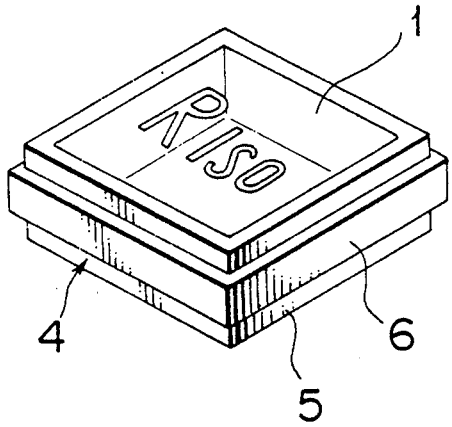
FIG. 2 is a perspective view of the apparatus of FIG. 1, showing the mimeographic master plate having been put up in the apparatus.
Figure 3:
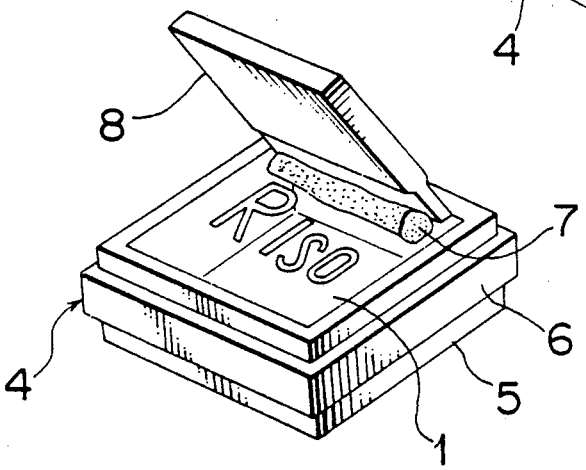
FIG. 3 is a perspective view showing the manner in which a picture forming method according to the invention is carried out by using the apparatus and mimeographic master plate of FIG. 2.
Figure 4:
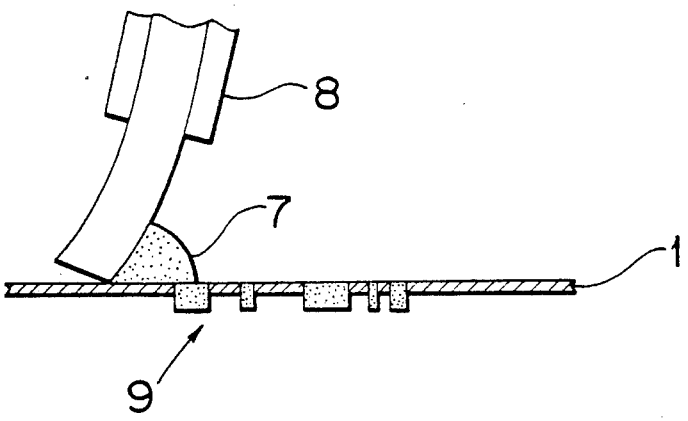
FIG. 4 is an enlarged cross-sectional view showing the squeezing step of FIG. 3.

Subsequently a picture forming material 7 such as of a resin described below is placed on the screen 3 of the tensioned master 1, as shown in FIG. 3, whereupon the picture forming material 7 is forced out through the thermoplastic synthetic resin film 2 of the master 1 by squeezing several times with a squeegee 8, as shown in FIGS. 4 and 5(*a*). The picture forming material 7 having thus been forced out is progressively moved vertically downwardly, as retained by the screen 3, with keeping a predetermined contour or shape corresponding to the picture in pores or stencil. As a result, a cubic picture 9 of a predetermined shape corresponding to the picture-in-pores, i.e. original picture, in the master 1 has been formed with fidelity. In order that the formed picture 9 should remain its predetermined shape perfectly, the thus forced-out picture forming material 7 may be hardened by subsequent treatment such as heating, or exposing to the atmosphere. Here in the specification, "hardening" means to make unable to deform plastically, but not resiliently, when exterior stress is applied.

The picture forming material 7 for use here in this embodiment requires fluidity such as to pass through the pores in the master 1. The picture forming material 7 must have an additional property such that a predetermined shape of the picture formed can remain stably, after the material 7 has been forced out from the pores in the master 1. Such a material to satisfy these conditions is exemplified by a resinous material, such as silicone rubber, having a thixotropic property, i.e., a property capable of flowing only when stress is applied. A picture having been formed of a watersetting silicone rubber absorbs water in the atmosphere to be hardened when exposed to the atmosphere for a relatively short time. As a result, this picture has been in a perfectly stable state to constitute a resilient picture 9 representing the picture in the master 1 with fidelity. When a moisturesetting silicone resin or a modified silicone resin is used for the picture forming material, the forced-out material may be soaked in a hot water or exposed to vapor to facilitate hardening.

Practically, this resulting picture, as microscopically shown in FIGS. 5(*b*) and 5(*c*), bulges in a pattern corresponding to the shape of the screen 3, with its surface being composed of a multiplicity of convex or partial spherical surfaces. As a consequence, the picture surface, as viewed by naked eye, looks like velvet, giving a soft and gentle touch. After the picture 9 has been hardened to become stable, its surface may be polished or coated with rubber powder according to need. Otherwise when the picture 9 is to be used as a letterpress stamp, dents in the irregular surface of the stamp can hold ink.

For the picture forming material 7, a variety of materials may be selectively used unless it does not satisfy predetermined conditions described below. For example, thermosetting resin, photosetting resin or UV-setting resin may be used; in that case, to keep a predetermined shape corresponding to the picture-in-pores, it is necessary to take a subsequent treatment, i.e., applying heat, light or ultraviolet rays over the picture forming material after the material has been forced out.

During the foregoing process, since the distal edge of the squeegee 8 comes in substantially linear contact with the master 1, it is possible to apply a remarkably large pressure to the picture forming material 7, compared with the case where pressure is applied on the entire surface of the master 1 perpendicularly thereto. Therefore, the picture forming material 7 can be easily squeezed out from the small pores by the squeegee 8. In the squeezing operation with the squeegee 8, the amount of the forced-out picture forming material 7, namely, the height of the picture 9 is virtually determined according to the number of strokes of the squeegee 8, irrespective of the amount of the picture forming material 7 standing between the distal edge of the squeegee 8 and the master 1, if this amount is more than predetermined. Further, when squeezing the picture forming material 7, the picture could come out obliquely as the master receives a force in a slightly sinking and moving direction. Consequently, when a strain-free, full-detail picture is to be obtained, it is preferred to set up the master 1 on the apparatus 4 at a tension as high as possible.

Although it is ideal that pressure is applied by the squeegee 8 as mentioned above, vacuum or atmospheric pressure be utilized in squeezing the picture forming material. Since pressure is applied over the entire surface of the master 1 at one, vacuum is suitable for squeezing the picture forming material in a small area so that the laborious squeezing operation with the squeegee can be eliminated.

The cubic picture 9 formed in the manner discussed above may be used for a variety of applications.

For example, when it is to be used as a letterpress in printing, this cubic picture may be wound on a rotary drum to conduct rotary printing. In an alternative form, this picture may be attached to a support plate with the same picture forming material to provide a letterpress. When it is used as such a letterpress, the picture forming material 7 may preferably comprise modified silicone or polyacrylate rubber which is easy to moisten with ink.

Further, the picture may be formed of a colored picture forming material, or may be colored after formed. The resulting picture may be used as a name plate, emblem or the like. For this purpose, the formed cubic picture may be attached to a support plate, with or without removing from the master 1. In the latter case, i.e. with the master 1, the picture forming material 7 is placed on the thermosensitive film 2 of the master 1 to push out a picture from the screen 3 so that a regular picture can be obtained. At that time, when the hardened material 7 is coated with a paint if silicone resin is used for the material 7, and when an adhesive tape is pushed against the paint after dried, the paint is removed only from the cubic picture of silicone resin as the adhesive tape is peeled off. Thus the paint stands only on the master 1, which serves as the background. To give a color to the picture forming material 7, various kinds of pigments, dyes or powders may be simply mixed in the material before squeezing. In the illustrated embodiments, ink for a printing apparatus named "PRINT GOKKO" (tradename, product by RISO KAGAKU KOGYO KABUSHIKI KAISHA) may be used. Also, a fluorescent dye, a light-regenerating dye, a perfume, etc. may be mixed in the picture forming material to selectively give a variety of functions or properties.

According to the foregoing embodiment, a relief (cubic) picture representing the picture-in-pores and hence the original picture can be formed quickly and inexpensively without using a template.

In the illustrated embodiment, a cubic picture was formed from a single kind of picture forming material.

Alternatively, the color and/or quality of a picture forming material may be changed during the squeezing step.

Figure 6A:
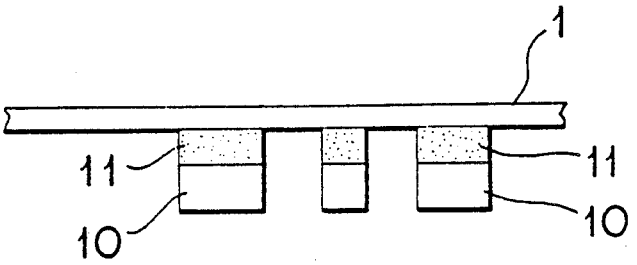
FIG. 6(*a*) is an enlarged schematic view showing a picture having been formed in the method according to one aspect of the invention.
Figure 6B:
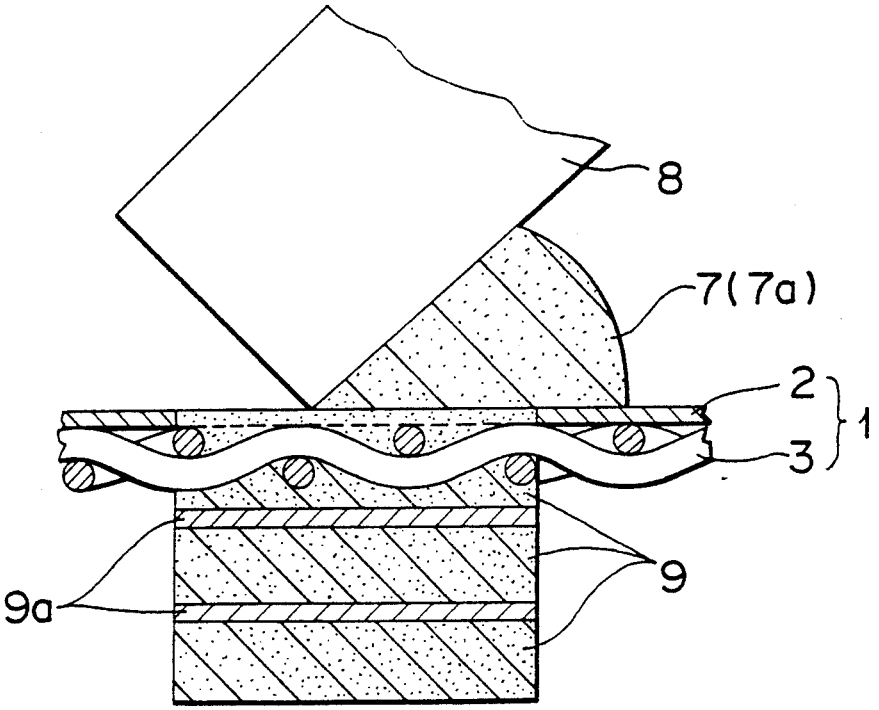

For example, as shown in FIG. 6(*a*), a first layer is formed of a picture forming material (e.g., modified silicone rubber) 10 which has a suitable degree of resilience after hardened and hence has excellent printability. Then, a second layer is formed of another picture forming material 11 having a quality such that it becomes hard after hardened. As a result, the raised portions has become resistant against external stress and is hence hard to rupture.

If picture forming materials different in color are used for the first and second layers, a cubic picture giving a more solid touch can be achieved.

Further, in forming a multilayered picture as shown in FIG. 6(*b*), at least one picture forming material 7*a* to be used may have a quality such that it is unable to harden, or able to harden slowly, under the hardening condition of the remaining picture forming materials 7. In this form, the hardened layers 9 formed of the materials 7 can be separated along the non-hardened layers 9*a* formed of the material 7*a* so that a plurality of cubic pictures can be obtained concurrently.

In this embodiment, a greasy unharden silicone resin which does not harden when processed was used for the layers 9*a*. If such unhardening material is squeezed a few times alternatively after squeezing the picture forming materials 7 which is able to harden, the formed cubic picture or hardened layers 9 can be easily removed from the master 1. Further, since no residue stays in the picture portion of the master, the master may be reused.

The material unable to harden or able to harden slowly is exemplified by vaseline, paraffin and paste, in addition to the greasy non-hardened silicone resin. Yet, a material soluble with hot water after hardened, e.g., vinyl acetate resin or water color may be used.

The master 1 used in the foregoing embodiments is a so-called high-mesh master which is to be used in a printing apparatus named "PRINT GOKKO" (tradename, product by RISO KAGAKU KOGYO KABUSHIKI KAISHA) and which is composed of a 200 mesh/inch screen and a thermosensitive film of vinyl chloride laminated over the screen. This master 1 is commonly used as it is easy to make with using a flash bulb or lamp. When using PET (polyethyleneterephthalate) for the thermosensitive film, it is possible to reduce the thickness of the film itself to 2 μm. Therefore, as a little residue stays during plate-making, a neat picture with increased fidelity can be obtained.

The picture forming material may be forced out from either the film side or the screen side of the master 1 so that either a regular picture or a reverse picture may be selected with ease.

Yet, in the illustrated embodiment, the thermosensitive master 1 was shown as one example of a mimeographic master plate. A mimeographic master plate as a base of a cubic image should by no means be limited to the thermosensitive type; for example, it may be a film or a thin plate-like member in which a multiplicity of pores has been formed for passage of the picture forming material.

Figure 7:
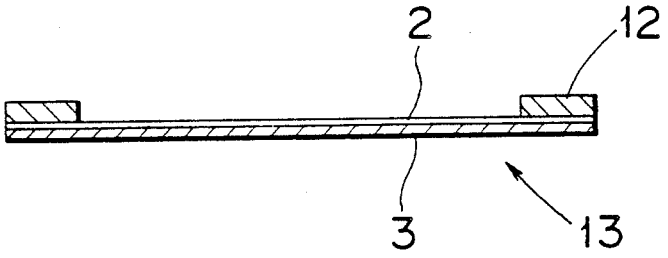
FIG. 7 is a cross-sectional view of a mimeographic master plate adapted to be used in the apparatus according to the invention.
Figure 8:
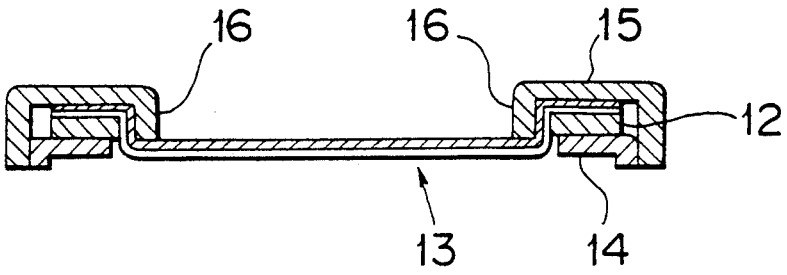
FIG. 8 is a cross-sectional view showing the mimeographic master plate of FIG. 7 having been put up in the apparatus according to the invention.

FIG. 7 shows a master 13 including a porous support member and a frame member 12, wherein the porous support member is composed a thermosensitive film 2 and a porous screen 3. The frame member 12 is attached to the film side of the porous support member. FIG. 8 shows a modified picture forming apparatus according to a second embodiment which apparatus is a tensioning mechanism for giving to the master 13 a predetermined degree of tension. This tensioning mechanism includes an inner frame 14 and an outer frame 15, in which an edge portion 16 projects from an inner edge of an outer frame 15 into the interior of the inner frame. The frame member 12 of the master 13 is placed on the inner frame 14, over which the outer frame 15 is lowered to secure the frame member 12 by the inner and outer frames 14, 15 so that the edge portion 16 of the outer frame 15 pushes the porous support member of the master 13 downwardly to give a tension to the master 13. With this construction, the extent of downward pushing of the master 13 can be determined as desired by setting the size (height) of the edge portion 16 to a suitable value, so that it is possible to optionally set the degree of tension to be given to the master 13. It is therefore possible to form a picture representing the original picture with increased fidelity.

Figure 9:
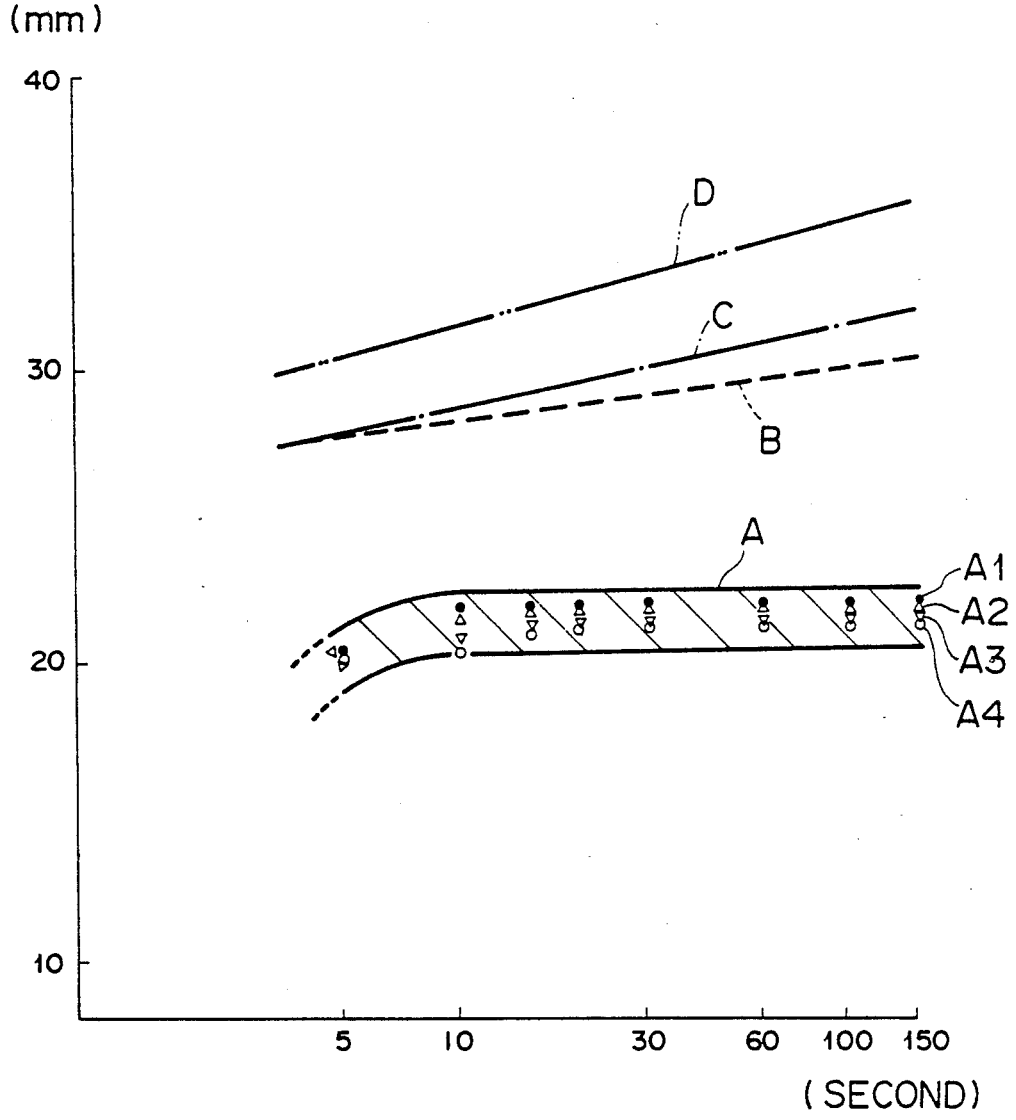
FIG. 9 is a graph showing the rigidity of a picture forming material.

FIG. 9 is a graph showing the results of measurement of hardness of a resinous material A, as the picture forming material used in the illustrated embodiment, by a spread meter before hardening, the hardness being required to pass through the master plate. The vertical axis of this graph represents diameter (mm) of the material as it is smashed to spread, while the horizontal axis stands for time (second) in logarithm.

It is understood from this graph that each kind of the resinous materials A1 through A4 remains substantially a constant value after a lapse of 10 seconds.

Particularly preferably, the resinous material to be used in this embodiment may have the characteristics of A1 through A4. These resinous materials A1 through A4 are seen in the range A filled with diagonal lines in the graph of FIG. 9. In FIG. 9, lines B, C and D show the results of measurement of several kinds of ordinarily used mimeographic inks.

As shown in FIG. 9, the resinous material as the picture forming material used in the illustrated embodiment is controlled in such a manner that the values of a spread meter with respect to 1 minute are preferably within the range of from 19 to 24, more preferably from 20 to 22. It is understood that these materials are rather hard, compared with the ordinarily used mimeographic ink. Having this hardness, the material can keep its shape, by its own viscosity, without flowing after having passed through the master. Considering the operability of the squeegee 8, the material is preferably low in viscosity and high in structural viscosity.

Figure 10A:
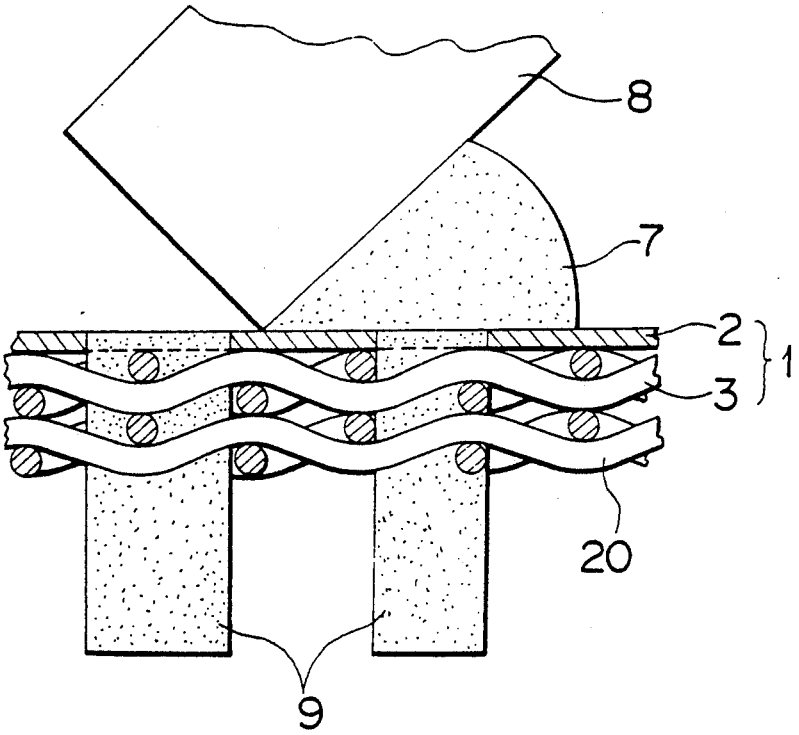
FIGS. 10(*a*) and 10(*b*) are cross-sectional views showing a picture forming method according to a still another aspect of the invention.
Figure 10B:
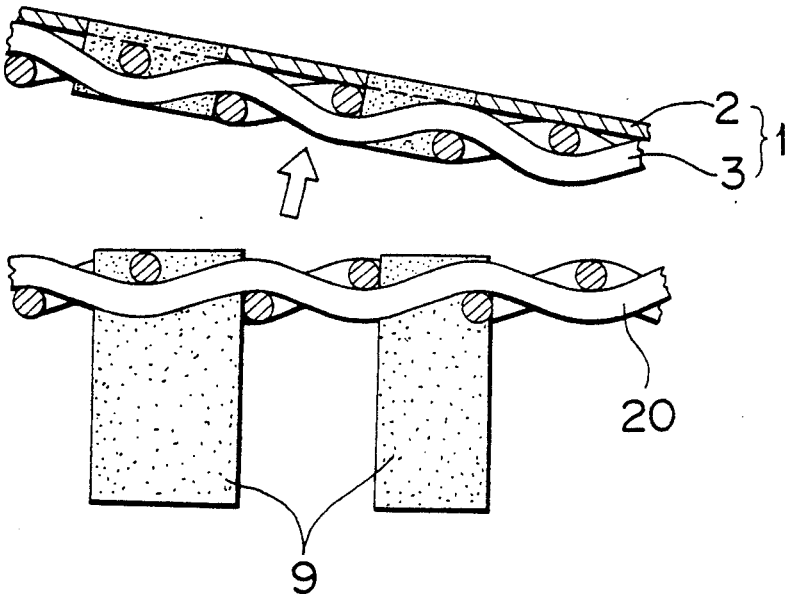

FIG. 10(*a*) shows a picture forming method according to another embodiment, in which a mesh sheet 20 (identical with the above-mentioned screen 3) is superimposed over a master 1 as the mimeographic master plate, whereupon the above-mentioned squeezing operation is conducted to force the picture forming material 7 to pass through the mesh sheet 20.

Then, as the master 1 is pulled off the mesh sheet 20, the forced-out cubic picture 9 is formed on the mesh sheet 20 as shown in FIG. 10(*b*).

The master 1 may be used repeatedly until the picture forming material 7 becomes hardened.

When the master 1 and the mesh sheet 20 are superimposed one over the other, a moire may influence to the picture. To minimize the influence due to a moire, the mesh number of the screen 3 of the master 1 may be different from the mesh number of the mesh sheet 20. For instance, the mesh sheet 20 may have 200 mesh- /inch, and the mesh sheet 20 may have 180 mesh/inch. Or the directions of mesh of the two mesh sheets may be inclined by an angle of about 10° with respect to each other.

Figure 11A:
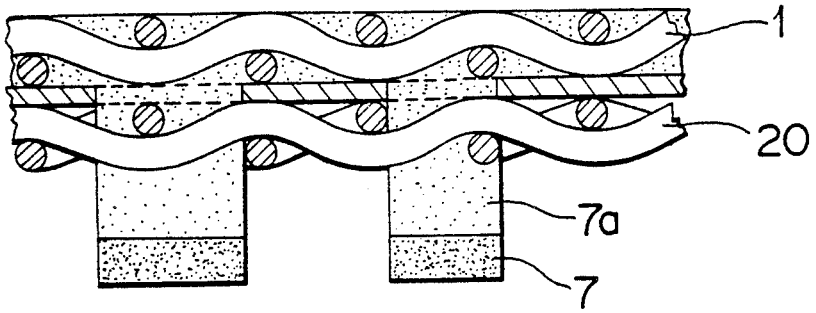
FIGS. 11(*a*) and 11(*b*) are cross-sectional views showing a picture forming method according to a still further aspect of the invention.
Figure 11B:
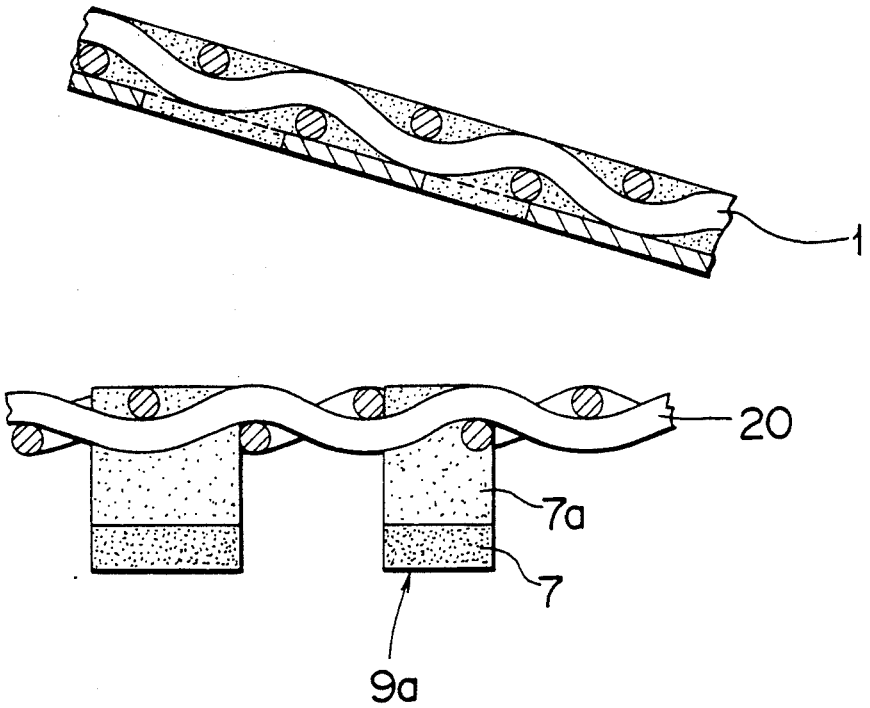

FIG. 11(*a*) shows a picture forming method according to still another embodiment, in which a master 1 as the mimeographic master plate is superimposed over one surface of a mesh sheet 20 (identical with the above-mentioned screen 3), whereupon the above-mentioned squeezing operation is conducted to force picture forming materials 7, 7*a* progressively to the other side of the mesh sheet 20 via the pores in the master 1. In this embodiment, two different qualities of picture forming materials 7, 7*a* were used.

Then, as the master 1 is pulled off the mesh sheet 20, the forced-out picture forming materials 7, 7*a* are left on the mesh sheet 20 in a predetermined shape as retained thereby, as shown in FIG. 11(*b*).

Subsequently, the forced-out picture forming materials 7, 7*a* are hardened and, as a result, a cubic picture 9*a* corresponding the picture-in-pores of the master 1 has been completed.

According to this embodiment, the master 1 may be used repeatedly until the picture forming materials become hardened.

In this embodiment, like the embodiment of FIG. 10, since the master 1 and the mesh sheet 20 are superimposed one over the other, a moire may influence to the picture. To minimize the influence due to a moire, the mesh number of the screen of the master 1 may be different from the mesh number of the mesh sheet 20, or the directions of mesh of the two mesh sheets may be inclined with respect to each other. The mesh number of the mesh sheet 20 must be equal to or smaller than the mesh number of the master 1. This is true because if the mesh sheet 20 has a mesh density higher than that of the master 1, the picture forming material 7 would stay between the master 1 and the mesh sheet 20, thus deteriorating the picture.

Figure 12A:
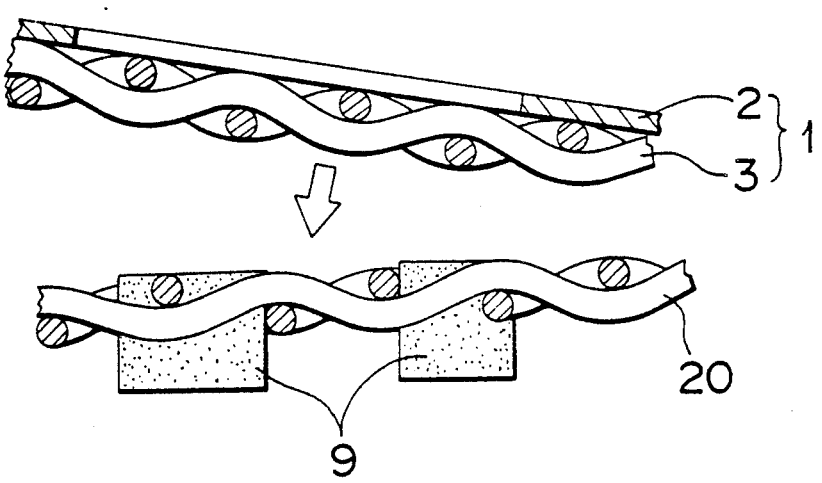
FIGS. 12(*a*), 12(*b*) and 12(*c*) are cross-sectional views showing a different picture forming method according to the invention.
Figure 12B:
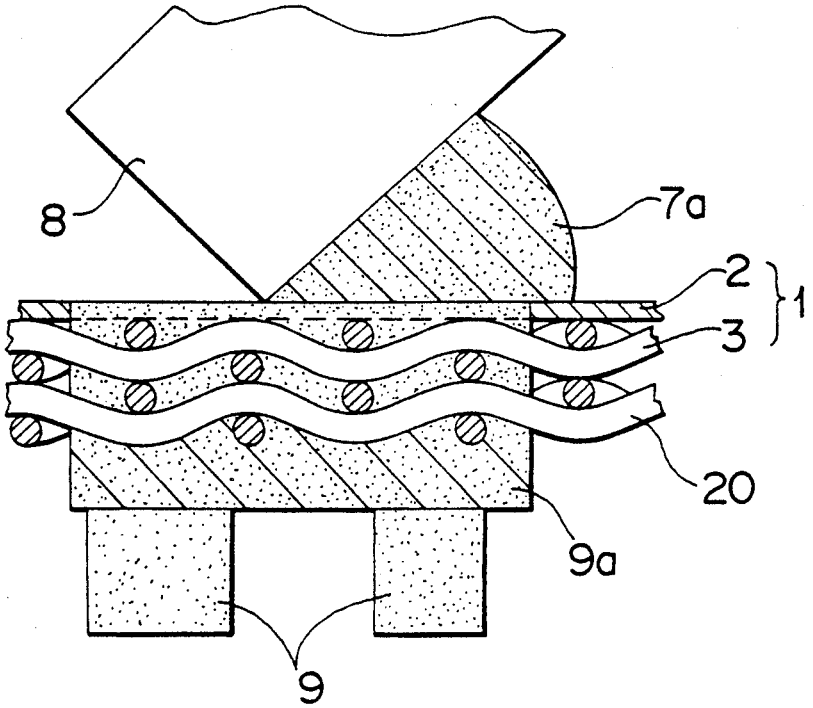
Figure 12C:
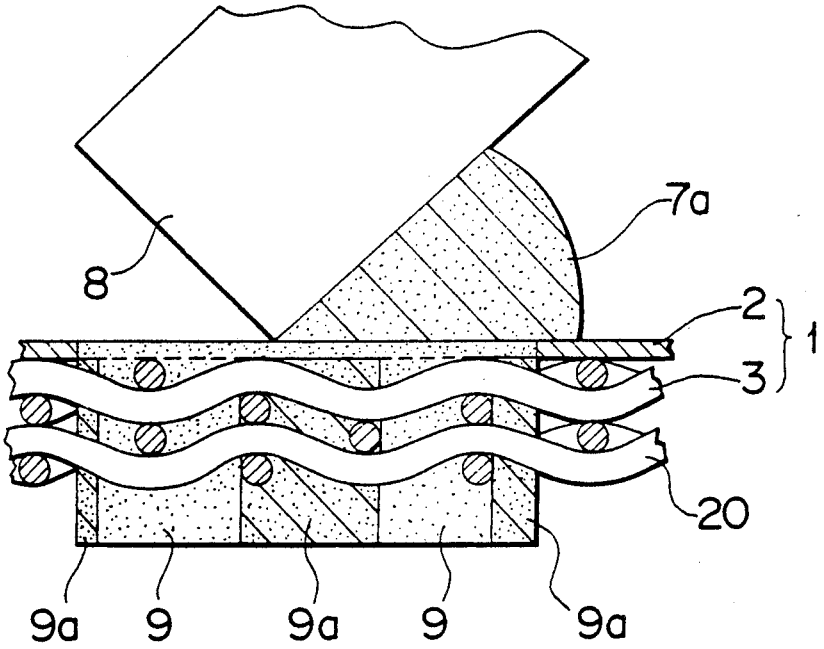

FIGS. 12(*a*) and 12(*b*) show a picture forming method according to a further embodiment. After a cubic picture 9 has been formed on a mesh sheet 20 in the manner shown in FIG. 12(*a*), another master 1 of FIG. 12(*b*), in which master a different picture-in-pores has been made, is superimposed over the surface of the mesh sheet 20 opposite to the bulged portion of the cubic picture 9. Then the squeezing operation is conducted, with using a picture forming material 7*a* of FIG. 12(*b*), in which case a new picture 9*a* can be formed so as to lie over the already formed picture 9 unless the picture 9 is attached to the mesh sheet 20 before hardened.

On the contrary, if the same procedures are conducted after the old picture 9 has become hardened, a new picture 9*a* can be formed contiguous to the old picture 9 as shown in FIG. 12(*c*).

According to the embodiments of FIGS. 10, 11 and 12, it is possible to repeatedly use the mimeographic master plate so that a plurality of pictures of the identical shape can be formed successively with ease. Further, using one or more separate mimeographic master plates, the picture forming materials may be forced to pass successively through the master plates to form a colorful, sophisticated picture. If a chromatically resolved original is used, it is possible to form a virtually fullcolor picture.

Figure 13A:
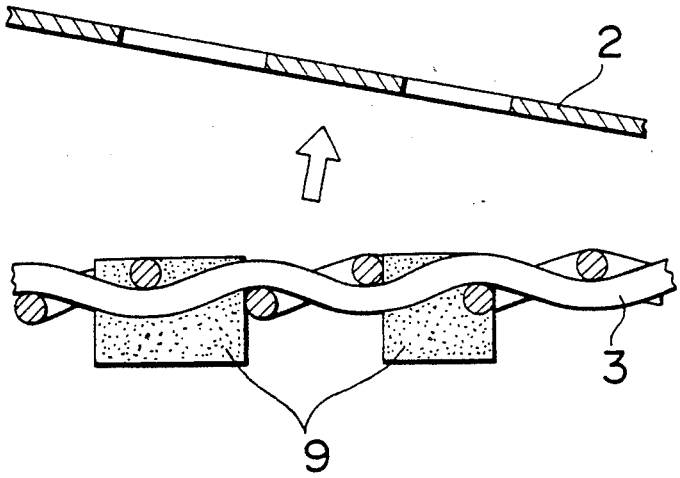
FIGS. 13(*a*)and 13(*b*) are cross-sectional views showing a further different picture forming method according to the invention.
Figure 13B:
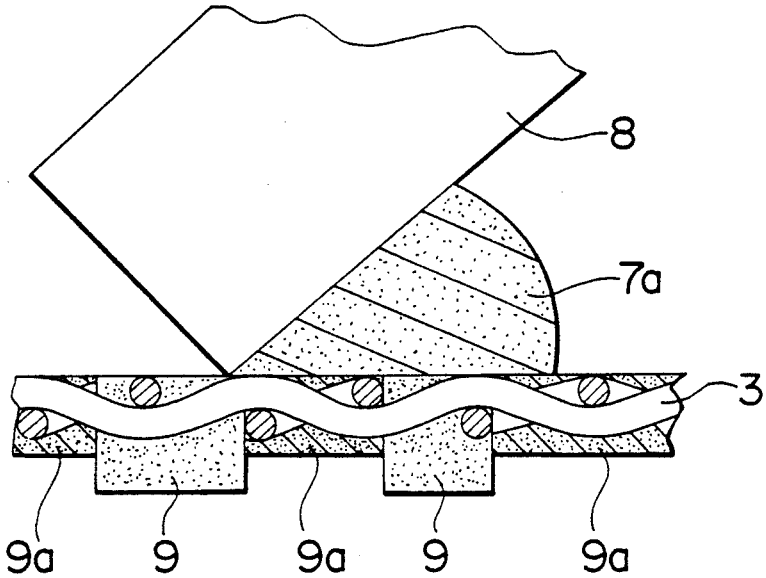

FIGS. 13(*a*) and 13(*b*) show a picture forming method according to a still further embodiment. The master 1 in this embodiment is composed of a thermoplastic synthetic resin film 2, as a layer in which a multiplicity of pores is made in a pattern corresponding to an original picture, and a screen 3, as a support which allows the picture forming material to pass therethrough. The film 2 and the screen 3 are mutually separable. After a desired cubic picture has been formed using a watersetting silicone resin as a picture forming material and then after this picture has become hardened, the film 2 is separated from the screen 3, as shown in FIG. 13(*a*). Then, a new picture forming material 7*a* is placed on the screen 3, as shown in FIG. 13(*b*), and is forced out through the master by squeezing with the squeegee 8. As a result, a new picture 9*a* has been formed contiguous to the already formed picture 9.

For instance, as the portions devoid of the old picture 9 are filled with materials of different color, it is possible to emphasize the contrast between the picture 9 and the background so that the picture can come out by using the material of a different color or quality along the entire peripheral portions of the picture.

In this method, if the portions except the picture 9 are filled with the material having a character or property different from that of the picture 9, e.g., if the picture 9 is formed of a hydrophilic material while the portions devoid of the picture 9 are filled with a water repellent material, it is possible to prevent stamp ink from adhering to the portions devoid of picture 9. Alternatively, if one material is hydrophilic while the other material is oleophilic, and if hydrophilic ink or oleophilic ink is selectively used as the stamp ink, it is possible to make a stamp corresponding to the selected picture 9 or 9*a*. This use may be applied also to the embodiment of FIG. 11 with similar results.

The separating of the film 2 will now be described in greater detail. The resin film 2 of the master 1 has a thickness of 7 μm and comprises vinyl chloride resin, while the screen 3 comprises polyester fibers of 200 mesh/inch. The film 2 and the screen 3 are adhered to each other by a binder of vinyl acetate resin. Therefore, when the picture forming material is soaked in hot water immediately after the picture 9 has been formed, the picture forming material of watersetting silicone resin is to hardened and, at the same time, the resin film 2 is contracted due to heat of hot water, and the adhesive binder is dissolved. Thus the nonpicture portion of the film 2 is separated from the screen 3, on which the hardened cubic picture is adhered. Although the adhesive binder is easy to solve even in a solvent such as of ether, hot water is preferable to solve the adhesive binder with safety.

In some of the foregoing embodiments, the formed picture 9 was fixedly attached to the master 1 or the mesh sheet 20. Alternatively, the picture may be removed from the master 1 or the mesh sheet 20 and may be attached to a separate support according to need. At that time, if the picture forming material 7 as hardened is small in adhesion strength to the master 1 or the mesh sheet 20, it can be peeled off the master 1 or the mesh sheet 20. Like the embodiment of FIG. 6(*b*), after the picture forming material 7 has been forced out by squeezing, if another picture forming material unable to harden, or able to harden slowly, under the hardening condition of the picture forming material 7 is placed, and further if the same squeezing operations are conducted several times, it is possible to easily separate the hardened picture forming materials 7 from the screen 3 of the master 1 or the mesh sheet 20.

According to any of the foregoing embodiments, various kinds of pictures or a cubic picture can be achieved. The picture formed according to this invention may be applied to a wide variety of uses, in addition to the letterpress for printing discussed above.

For example, this picture may be used as doorplate, nameplate, emblem, stamp, and display goods in shops, such as POP panel, price tag, plus equipments in restaurants, such as menu, coaster, and handcraft or fancy goods, such as key holder, applique, artificial flower, doll, and game goods such as scramble, jigsaw puzzle, cubic maze, plastic model kit, and arts such as cubic picture, print, and art tool. Further, if a non-toxic material is used to facilitate peeling of the master, the picture can be used in making food such as cookies. Still further, if an inorganic substance such as porcelain clay as pulverized into particles small enough to pass the mesh screen is used as the picture forming material, and then if the formed picture is calcined, a ceramic-type cubic article can be obtained.

Although various minor modifications may be suggested by those skilled in the art, it should be understood that we wish to embody within the scope of the patent grated hereon, as resonably and properly come within the scope of my contribution to the art.

What is claimed is:

1. A picture forming method comprising, preparing a mimeographic plate having pores therein corresponding to an original image, holding the mimeographic plate in the air under a predetermined tension, and applying a picture forming material forcibly on one side of the mimeographic plate, said picture forming material having fluidity at least when applied to the mimeographic plate so that the picture forming material, when forcibly applied to the mimeographic plate, passes through the pores, said picture forming material passing through the pores adhering to the mimeographic plate on a side opposite to the side that the picture forming material is applied to thereby provide a solid picture corresponding to the original image on the plate.

2. A picture forming method according to claim 1, further comprising hardening the picture forming material adhered to the mimeographic plate.

3. A picture forming method according to claim 2, wherein after the picture forming material is applied to the mimeographic plate, at least one different picture forming material is further applied to the mimeographic plate so that the solid picture with different picture forming materials is formed in layers.

4. A picture forming method according to claim 3, wherein said at least one different picture forming material is different from the picture forming material in at least color or quality.

5. A picture forming method according to claim 4, wherein said at least one different picture forming material does not harden when the picture forming material is hardened.

6. A picture forming method according to claim 5, wherein said picture forming material and at least one different picture forming material are alternately piled before hardening the picture forming materials, said picture forming materials, after hardened, being separated by means of said at least one different picture forming materials.

7. A picture forming method according to claim 1, further comprising placing a mesh sheet over one side of the mimeographic plate after the mimeographic plate with pores is prepared, said picture forming material being applied to the mimeographic plate, and removing the mimeographic plate from the mesh sheet after the picture forming material is applied to the mimeographic plate to thereby form the solid picture on one side of the mesh sheet.

8. A picture forming method according to claim 7, wherein a plurality of picture forming materials different in at least color or quality is prepared, said placing step of the mesh sheet, holding step, applying step and removing step being repeated for each of the picture forming materials.

9. A picture forming method comprising, preparing a mimeographic plate having pores therein corresponding to an original image, placing a substrate over the mimeographic plate, said substrate allowing a picture forming material to pass therethrough when forcibly applied thereto, holding the mimeographic plate and the substrate in the air under a predetermined tension, applying the picture forming material forcibly onto the mimeographic plate and the substrate from a side of the mimeographic plate, said picture forming material having fluidity at least when applied to the mimeographic plate so that the picture forming material, when forcibly applied to the mimeographic plate, passes through the pores, said picture forming material passing through the pores adhering to the substrate, hardening said picture forming material on the substrate, and applying a different picture forming material forcibly on the substrate so that the different picture forming material passes through portions of the substrate where the hardened picture forming material is not formed.

10. A picture forming method according to claim 9, further comprising removing the mimeographic plate from the substrate before hardening the picture forming material on the substrate.

11. A picture forming method according to claim 10, further comprising hardening the different picture forming material adhered to the substrate.

12. A picture formed by a method comprising, preparing a mimeographic plate having pores therein corresponding to an original image, holding the mimeographic plate in the air under a predetermined tension, applying a picture forming material forcibly on one side of the mimeographic plate, said picture forming material having fluidity at least when applied to the mimeographic plate so that the picture forming material, when forcibly applied to the (mimeographic plate) passes through the pores, said picture forming material passing through the pores adhering to the mimeographic plate on a side opposite to the side that the picture forming material is applied, and hardening the picture forming material to thereby provide a solid picture corresponding to the original image on the plate.

* * * * *